US006426489B1

(12) United States Patent
Elsasser

(10) Patent No.: US 6,426,489 B1
(45) Date of Patent: Jul. 30, 2002

(54) FLAT RESISTANCE HEATING ELEMENT

(76) Inventor: Manfred Elsasser, Fraubichl 20, A-6082 Patsch Oesterreich (DE)

( * ) Notice: Subject to any disclaimer, the term of this patent is extended or adjusted under 35 U.S.C. 154(b) by 0 days.

(21) Appl. No.: 09/744,564

(22) PCT Filed: Oct. 8, 1999

(86) PCT No.: PCT/EP99/05842

§ 371 (c)(1),
(2), (4) Date: Mar. 23, 2001

(87) PCT Pub. No.: WO00/10365

PCT Pub. Date: Feb. 24, 2000

(30) Foreign Application Priority Data

Aug. 10, 1998 (DE) ..... 198 36 148

(51) Int. Cl.[7] ..... H05B 3/16
(52) U.S. Cl. ..... 219/543; 219/213
(58) Field of Search ..... 219/543, 270, 219/211, 219, 464, 548, 528, 541, 213; 29/852; 428/446, 210; 346/76 PH

(56) References Cited

U.S. PATENT DOCUMENTS

| | | | | | |
|---|---|---|---|---|---|
| 2,540,295 | A | | 2/1951 | Schreiber | |
| 3,694,622 | A | * | 9/1972 | Bentley | 219/213 |
| 4,100,398 | A | * | 7/1978 | Levin | 219/541 |
| 4,346,277 | A | * | 8/1982 | Wojtecki et al. | 219/528 |
| 4,724,182 | A | * | 2/1988 | Kato et al. | 428/210 |
| 4,725,717 | A | | 2/1988 | Harrison | |
| 4,954,696 | A | * | 9/1990 | Ishii et al. | 219/548 |
| 4,973,826 | A | * | 11/1990 | Baudry et al. | 219/464 |
| 5,081,471 | A | * | 1/1992 | Thomas | 346/76 PH |
| 5,361,183 | A | | 11/1994 | Wiese | |
| 5,408,069 | A | * | 4/1995 | Mischel, Jr. | 219/219 |
| 5,577,158 | A | | 11/1996 | Kallgren | |
| 5,643,480 | A | * | 7/1997 | Gustavsson et al. | 219/211 |
| 5,756,215 | A | * | 5/1998 | Sawamura et al. | 428/446 |
| 5,826,330 | A | * | 10/1998 | Isoda et al. | 29/852 |
| 5,889,261 | A | * | 3/1999 | Boardman | 219/543 |
| 6,184,497 | B1 | * | 2/2001 | Leigh | 219/270 |

FOREIGN PATENT DOCUMENTS

| | | |
|---|---|---|
| DE | 1 026 890 | 3/1958 |
| DE | 1 288 702 | 7/1958 |
| DE | AS 1 288 702 | 2/1969 |
| DE | 15 65 841 | 2/1970 |
| DE | OS 2 307 640 | 8/1974 |
| DE | 24 49 676 A1 | 4/1976 |

* cited by examiner

*Primary Examiner*—Teresa Walberg
*Assistant Examiner*—Leonid M Fastovsky
(74) *Attorney, Agent, or Firm*—Oliff & Berridge, PLC

(57) ABSTRACT

The present invention relates to a heating member with a resistive surface (1) that comprises at least one resistive layer (10), two conductive layers (20, 30) as well as isolation layers (40, 50) respectively arranged between said layers (10, 20, 30). The first conductive layer (30) is made in the form of a neutral conductor, while the second conductive layer (30) is made in the form of a protection conductor. In a preferred embodiment of this invention, the resistive layer (10) comprises respectively a contact electrode (11, 12) on both sides in the edge area, while the first and second conductive layers (20, 30) each include a contact electrode (21, 31) in the edge area. The contact electrodes (11, 12, 21, 31) protrude longitudinally and on at least one side above their respective layers (10, 20, 30). A contact electrode (12) of the first resistive layer (10) coincides with the contact electrode (31) of the first conductive layer (30). The second electrode (12) of the second conductive layer (10) are offset relative to each other and relative to the contact electrode (21) of the first conductive layer (20).

16 Claims, 3 Drawing Sheets

FLAT RESISTANCE HEATING ELEMENT

Figure 1:
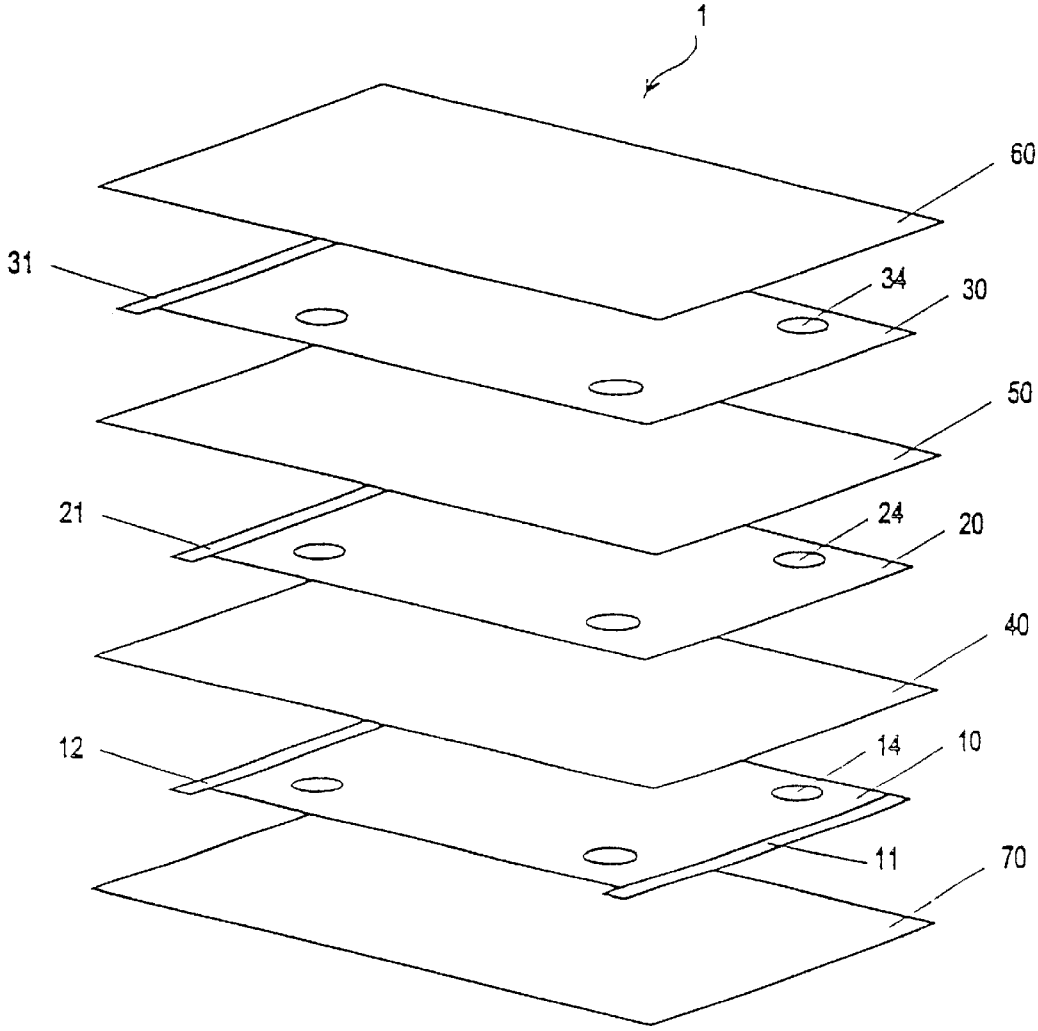

The present invention concerns a flat resistance heating element.

Electrical resistance-heating elements find manifold uses, for instance for room heating. Relative to heating elements having resistors in the shape of rods, tubes or coils, those having flat resistive planes prove to be particularly advantageous, since they can give off heat all across the surface of a resistive layer.

In some areas, for instance in old buildings, it may be necessary to provide high-power flat resistance heating elements. However, at the same time such a flat resistance heating element must also be able to serve without safety risks, even when mechanically damaged or exposed to environments with water splashes.

It is the task of the present invention to provide a flat resistance heating element, subsequently simply designated as heating element, which satisfies these requirements, can be operated with line voltage, can moreover be installed and electrically connected in a simple way, and in which several electroconductive layers are provided which have contact electrodes inserted or applied in such a way that only a selected number of contact electrodes is reached when the heating element is provided with contacts at a given position.

From the German Offenlegungsschrift (open patent application) OS 2449676, a grounded flat resistance heater is known that can be protected through an earth-leak circuit breaker (ELCB). It consists of an insulating supporting sheet having on one side a conductive coating that serves as heating layer and is to be connected to the electrical power supply, and on the other side a further electroconductive coating serving as a layer to be grounded. One can choose to also coat the peripheral conductive layers with electrically insulating layers.

It is an incisive disadvantage of this kind of flat heating element that in the operating state, i.e., with the power connected, a capacitive feedback always develops between the heating layer and the grounded layer which, depending on the size of the heating layer, gives rise to a more or less pronounced leakage current at the grounded layer. This means that depending on the size of a given heating element, a suitable earth leak circuit breaker or ELCB must be selected or, conversely, the size of a desired heating element must be adapted to the leakage-current tolerance of a given ELCB in order to prevent premature and undesired triggering of the ELCB.

A similar kind of flat heating element is described in the German Auslegeschrift (open patent application) AS 1288702. There, too, a resistive heating layer is separated from a second conductive layer, particularly a protective metal foil that is to be grounded, by an insulating layer, and where the layer to be grounded either is itself realized as a fusible cut-out consisting of readily fused metal, or where a fusible cut-out is inserted into the circuit of the heating layer and/or the grounded layer. In this type of flat heating element, too, the peripheral conductive layers can be covered by insulating layers. As a further protection, an additional metal foil formed as fusible cut-out and also separated from the heating layer by an insulating layer can be applied to the backside of the heating layer.

This type of embodiment of a flat heating element, which originated in the year 1957, aims particularly at measures providing the best possible assurance of electrical safety of the installation for the user at that time, and which were supposed to cause a sufficiently rapid interruption of the circuit in the case of possible short circuits. Nowadays this safety engineering problem is tackled much more elegantly and reliability by the earth leak circuit breakers (ELCB) that have since been developed.

The present invention, to the contrary, is based on recognizing that complete independence between the make of the ELCB and the size of the heating element can be achieved when the ground lead (safety ground) is kept essentially completely free of capacitive leakage currents. Relative to known flat heating elements, this has rather substantial advantages, both for practical applications and for the authorization procedures or certification procedures defining the level (class) of protection according to standard specifications of the competent technical inspection bodies. With it, it is for the first time possible to fit buildings or other objects with flat electrical resistance heating units of arbitrary size without the need to pay special attention to the ELCB, which in most cases has already been installed. Also, in contrast to existing types of flat heating elements, a certification of the heating elements according to the invention with respect to their level (class) of protection can be performed and issued regardless of size. Moreover, the capacitve leakage current in the ground conductor (safety ground) would also constitute undesirable interfering parameters because of the additional phase shifts in the ELCB region.

The cited disadvantages of the state of the art can be overcome and the precited advantages of the present invention can be attained according to the invention by a heating element according to claim 1. In the case of mechanical damage to the heating element, for instance, a circuit breaker or earth-leak circuit breaker can be triggered by the safety ground. Through this first conductive layer which functions as an additional neutral conductor, a capacitive coupling between the resistive heating layer and the safety ground is fundamentally suppressed. The neutral conductor screens the safety ground capacitively with respect to the resistance heating layer. The flat neutral conductor and the superimposed, flat safety ground are essentially at the same potential. Hence, a big capacitive leak current cannot flow via the safety ground between these two flat conductors, regardless also of the size of the total resistance heating element, which might be composed of individual elements.

Further embodiments are outlined in claims 2 to 16.

For the heating element to be put into operation, one contact electrode of the resistive layer is connected to the neutral conductor, the other is connected to phase, so that a current flow is generated in the plane of the resistive layer causing it to warm up and give off the heat to the surroundings.

Because of its design, the heating element according to the invention can be contacted with simple means. Thus, electrical contact can be made to the heating element according to the invention by inserting contact elements, for instance contact tips, extending through the thickness of the heating element. Such a contact tip is electrically connected, either to phase or to the neutral conductor or to the ground of the power supply; when such a contact tip is inserted into the heating element according to the invention, it is exclusively connected with the desired contact electrodes of a given layer. A short circuit between the individual contact electrodes can thus be avoided.

Beyond that, the design of the heating element according to the invention also permits a gradual or positive engagement between the power supply cable and the contact electrodes to be established. Such a connection can be brought about by contacting means making in-depth contact with the contact electrodes. In this case clamps can be used which engage from above and below via electroconductive contact blades or contact teeth introduced at predefined locations into the heating element. This in-depth contact is only possible with the heating element according to the invention. If an additional safety ground or a screening was applied to a traditional heating element, a short circuit would be brought about between the individual layers through the pressure applied to introduce the contact element and through the contact element itself. Apart from the precise connection of predefined contact electrodes, this in-depth contact has the additional advantage that the positive engagement between heating element and power supply cable can also support tensile stress and shear stress.

The heating element according to the invention can be powered with line voltage, hence the installation requirements for such a heating element are low. Transformers and other big components that would be needed for low-voltage elements can be dispensed with when using the heating element according to the invention. In view of these low installation requirements, a multitude of applications open up for the heating element according to the invention.

A direct contact between contact electrodes is avoided over the entire length of the heating element by the arrangement of the contact electrodes envisaged according to claim 3.

According to the embodiment of claim 4, the entire heating element can be enclosed and sealed against humidity by insulating layers arranged peripherally, and risks arising when touching the surface heating element can thus be avoided.

According to the embodiment of claim 4, the entire heating element can be enclosed and sealed against humidity by insulating layers arranged peripherally, and risks arising when touching the flat resistance heating element can thus be avoided.

Preferred materials for the resistive mass are described in claim 5. It is one advantage amongst others when using an appropriately selected, electroconductive polymer in the resistive mass that the power of the heating element can be raised relative to that obtained when using carbon black.

The embodiment according to claim 7 has the further advantage, apart from advantages with respect to production engineering, that the entire heating element has a high flexibility, for instance when electroconductive polymers are employed, and that on account of the elasticity, it is stable against mechanical loads and thermal fluctuations and that it is readily stored, transported, and installed without mechanical damage.

According to the embodiment following claim 9, the heating element has openings which can for instance be circular in shape, and make it possible to fix the heating element at the wall or floor for instance. A fastening part, for instance a screw, can be passed through the openings without causing a short circuit of the conductive layers and the resistive layer.

The design of the heating element according to claim 10 offers possibilities of contact at different points of the heating element. For instance, depending on the dimensions of the zone to be covered by the heating element, the appropriate contact electrodes from which the path to the current supply leads is shortest can be selected in each layer.

In this connection the embodiment according to claim 11 is preferred, because in this way one can achieve heating over the entire surface area of the subdivisions that is delimited by the contact electrodes.

In an embodiment according to claim 12, the zone to be heated can be adjusted to the width of the heating element, while in an embodiment having several pairs of contact electrodes in the resistive layer, this width can be varied between the spacing of a contact electrode pair and the total width of the heating element.

According to a particularly appropriate embodiment according to claim 13, cutting lines along which the heating element can be subdivided are created by band-shaped gaps between the subdivisions of each layer. When a heating element is cut apart in such a zone that is free of resistive mass or conductive material, renewed possibilities for making contact arise because of the continuous contact electrodes. The heating element according to the invention can thus be cut down to any size needed without losing the advantages of the contact electrodes protruding beyond the subdivisions and the attendant possibilities for making contact.

Preferably, in this case the subdivisions are arranged according to claim 14, so that it is guaranteed when cutting up a heating element according to the invention that along the cut, none of the subdivisions in the resistive layer or in the first or second conducting layer are openly exposed, that is, not insulated; therefore, contacts can be provided without any risk.

The invention will now be further explained with the aid of the attached drawings.

Shown are

Figure 2:
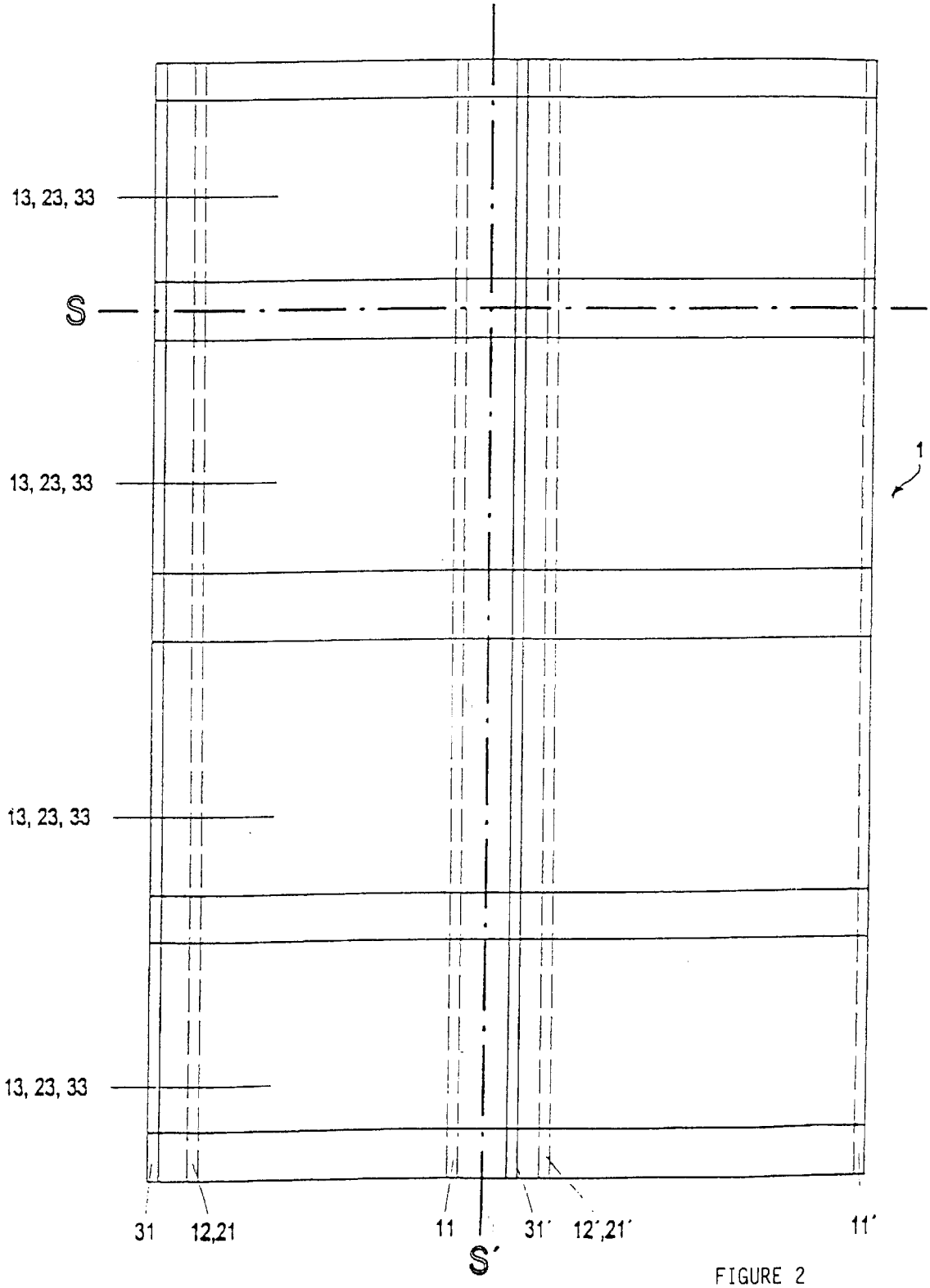
Figure 3:
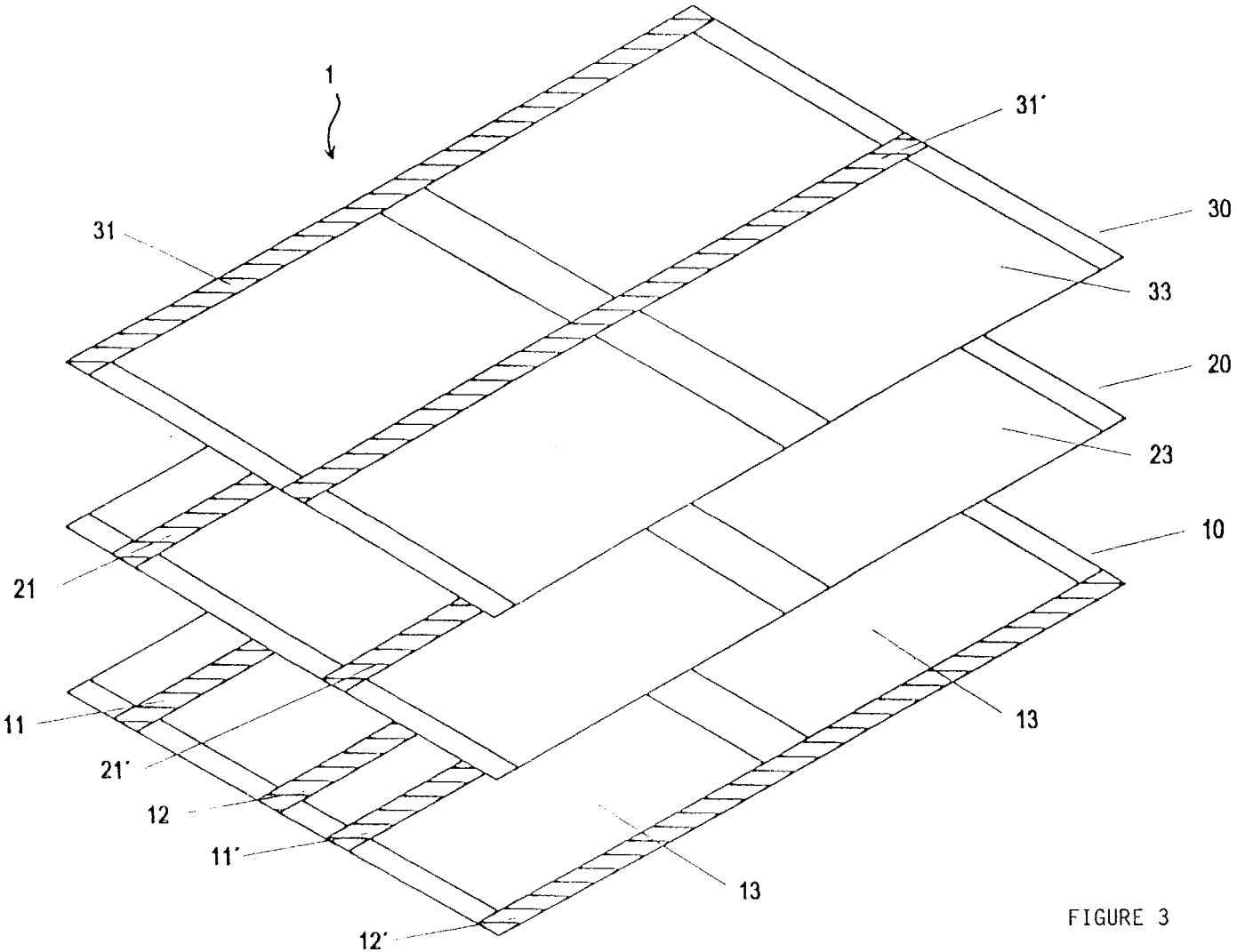

FIG. 1 a schematic exploded view of a heating element according to the invention, FIG. 2 a top view of an embodiment of the heating element with subdivisions, FIG. 3 a schematic exploded view of a heating element with subdivisions.

In FIG. 1 a heating element 1 is represented in which a resistive layer 10 is arranged between two contact electrodes 11, 12 extending along the sides of the resistive layer 10. This resistive layer 10 with the contact electrodes 11, 12 is situated between two insulating layers 70, 40. On top of the upper insulating layer 40 a first conductive layer 20 is arranged which has a contact electrode 21 in the border region on one side. On top of this first conductive layer 20 there is a further insulating layer 50 which separates the conductive layer 20 from the second conductive layer 30. The second conductive layer 30 also has a contact electrode 31 on one side. A further insulating layer 60 is arranged on top of the second conductive layer.

The contact electrode 21 of the first conductive layer 20 which follows after the resistive layer (10) is exactly superimposed with the contact electrode 12 of the resistive layer. In this way contact can be established by inserting a contact element, for instance a contact tip or a contact blade, through these two contact electrodes. The contact electrode 21 of the first conducting layer 20 which is realized as an additional neutral conductor and the contact electrode 12 functioning as neutral conductor which is attached to the resistive layer 10 are connected to the neutral conductor of the power supply. For higher operating safety, the contact electrode 31 of the second conductive layer 30 which is realized as a safety ground to be connected to ground is preferably arranged so as to be laterally offset relative to the contact electrodes 12 and 21, and hence in projection is not superimposed with these. In the embodiment represented, the contact electrode 31 is offset towards the left relative to the contact electrodes 21 and 12. However, it is also within the scope of the invention to arrange the contact electrode 31 so as to be offset towards the right relative to the contact electrodes 12, 21, i.e., in the direction of the second contact electrode 11 of the resistive layer 10. When piercing a contact element through this contact electrode 31, only this electrode is brought in contact with the power supply. A short circuit with the other contact electrodes 12 and 21 cannot occur. Thus, protective grounding of the heating element is possible through this second conductive layer 30 without the development of leakage currents, as outlined in detail previously.

The second contact electrode 11 of the resistive layer 10 is connected to the phase of the power supply, according to the invention.

As can be seen in FIG. 1, the ends of the contact electrodes 11, 12, 21, 31 project on one side beyond the respective layers 10, 20, 30. Hence the contacts being made with the contact electrodes in this protruding region can be realized with contact elements which extend through the heating element without giving rise to a short circuit with another layer.

FIG. 1 further shows openings 14, 24, 34 in layers 10, 20, 30. These openings 14, 24, 34 are arranged in such a way in the respective layers 10, 20, 30 that in projection they are superimposed. For fastening of the heating element 1 at a wall or on a floor, one can for instance pass a screw through these openings. The screw then comes into contact, only with the insulating layers 40, 50, 60, 70 but not with the electro-conductive layers 20, 30 and the resistive layer 10. In this way a short circuit between layers 10, 20, 30 is avoided, so that a reliable, safe possibility exists for fastening the heating element according to the invention.

In FIG. 1 the contact electrodes are arranged at the edges of the corresponding layers. However, it is also within the scope of the invention to arrange the contact electrodes in such a way that they are at a distance from the edge within the border region of the respective layer.

An advantage of the heating element according to the invention on one hand is given by the possibility of simple and reliable contacts arising from the mutual arrangement of the contact electrodes and by the possibility to operate this heating element with 220-volt alternating current. When applying line voltage to the heating element, a grounding of the element must be possible. This is realized through the second conductive layer. In this case the contact electrode 31 of the second conductive layer is connected to the protective ground of the power supply.

The first conductive layer 20 is provided to screen this protective ground against the resistive layer and the contact electrodes situated in it. This layer 20 is connected with the neutral conductor of the power supply and at the same time contacted with one of the contact electrodes of the resistive layer.

In FIG. 2 a top view of another embodiment of the heating element according to the invention is represented. For easier understanding the insulating layer 60 is not reproduced in this figure. In the embodiment represented, the second conductive layer 30 has two contact electrodes 31, 31'. Each of these contact electrodes is associated with one pair of contact electrodes 11, 12 or 11', 12' of the resistive layer 10. In addition, one contact electrode 21 or 21' of the first conductive layer 20 is associated with each contact electrode pair. The contact electrodes 12, 21 and the contact electrodes 12', 21' are fully superimposed. On the other hand the contact electrodes 31 and 31' are laterally offset relative to these superimposed contact electrodes 12, 21, 12', 21'. The distance between the electrodes 31 and 12, 21 is small as compared with that between the contact electrodes 11 and 12 of the resistive layer. The current flow produced when applying voltage occurs in the region between the contact electrodes 11 and 12, so that this region is heated. In projection, the contact electrode 11 is spaced apart from the contact electrode 31' associated with the nearest contact electrode pair 11', 12'. This distance is also small relative to the distance between electrode pair 11, 12 or 11', 12'.

Extending over the length of the heating element 1, subdivisions 13, 23, 33 are provided which have conductive material within the conductive layers 20, 30 and resistive mass within the resistive layer 10. The subdivisions 13, 23, 33 of the individual layers are superimposed in projection. Gaps exist between these subdivisions where neither resistive mass nor electroconductive material is present. These gaps extend in the form of bands over the entire width of the heating element. The dimensions of the bands are small relative to those of the subdivisions 13, 23, 33. The gaps serve as potential cutting lines S when cutting the heating element according to the invention into pieces. Within these gaps one merely finds the insulating layers and the contact electrodes extending throughout the entire length of the heating element.

It results from FIG. 2 that different regions of the heating element 1 can be connected to the power supply and thus heated. Thus, on one hand the contact electrodes 11', 12 in the resistive layer can be contacted via contact electrodes 21, 31 with a further terminal of the conductive layers 20, 30. When thus contacted, the heating element is heated over its entire width and over the subdivisions distributed over its length. The gap between the subdivisions is preferably kept small in order to minimize the loss of surface area over which heat can be given off.

FIG. 3 shows the exploded representation of a heating element 1 with subdivisions 13, 23, 33. In this representation one can see the position of the contact electrodes in the individual layers and in particular the positions of the contact electrodes of the individual layers relative to each other. The insulating layers 40, 50, 60, 70 are not represented in FIG. 3.

However, the insulating layers have dimensions such that in the directions of length and width they extend beyond the surfaces 10, 20, 30 and preferably cover the contact electrodes protruding beyond the ends of the layers.

The size of the heating element according to the invention is variable. Widths of for instance 250 mm, 500 mm, 625 mm, 1000 mm, 1250 mm or 1.5 m can be realized. The distance between contact electrodes of the resistive layer which form pairs of contact electrodes can also be varied. For instance, distances of for instance 10 cm can be provided. A finer subdivision, that is, a smaller distance between the electrodes of a contact electrode pair is also possible. In an embodiment such as that shown in FIGS. 2 and 3, such a finer subdivision makes it possible to cut the heating element to any desired width. To this end the heating element is cut apart at a position S' between a contact electrode 11 of the resistive layer and the contact electrode 31' of the second conductive layer. With the embodiment shown in FIG. 2, this would give two separate heating elements which can be installed immediately.

Thus, the heating element according to the invention has the further advantage that it can provide plural possibilities of contact across its width, inasmuch as several contact electrode pairs are present, and also across its length, because of the gaps between the subdivisions.

Resistive masses other than carbon black and heating varnish consisting of electro-conductive polymer that have sufficient flexibility can be used as materials for the resistive layer. The resistive layer can furthermore also consist of a support material coated with a resistive mass. Woven plastic, glass fiber mats, nonwoven fabrics and the like can be used as support material. However, any other internal or peripheral insulating layer can also be realized as a supporting layer for the corresponding adjoining or adhering conductive layer(s).

According to the invention, the conductive layers are preferably made of the same material as the resistive layer. It is particularly preferred here to use electro-conductive polymers. However, it is also within the scope of the invention to produce conductive layers from another material. Thus, aluminum foils can be used.

The thickness of the individual layers of the heating elements can be selected differently depending on the application. The peripheral insulating layers serve, not only for electrical insulation but also for protection against mechanical damage, and may for instance have a thickness of 50–200 μm, preferably 100 μm. The insulating layer situated between the resistive layer and the first conductive layer can for instance have a thickness of 50–100 μm, preferably 75 μm, while for the insulating layer arranged between the first and second conductive layer a smaller thickness of for instance 10–50 μm, preferably 30 μm can be selected.

The thickness of the resistive layer will vary particularly as a function of the material used. Where the resistive layer consists of a material which for instance is printed directly onto the insulating layer, its thickness can be small, for instance 10 μm. The resistive layer has a larger thickness in cases where it comprises a support material. Here thicknesses of for instance 3000 μm can be selected.

The thickness of the first conductive layer is typically in the region of for instance 10–50 μm, that of the second conductive layer is in the region of 50–100 μm.

The individual layers of the heating element according to the invention can be bonded together by traditional processes. It is preferred to apply the resistive layer and the conductive layers or the corresponding subdivisions in these layers in the form of a film of heating varnish comprising electroconductive polymer to one insulating layer each. These insulating layers that are covered with conducting material are provided with contact electrodes, either during the coating process or right after this process. It is preferred to use metal tapes, for instance tinsel tapes of copper, as the contact electrodes. The laminates thus generated are subsequently bonded together. In this operation the material of the resistive layer or the electroconductive layers can itself serve as the adhesive. However, it is also within the scope of the invention to bond the individual layers or prefabricated laminates together by insertion of plastic sheets, e.g., polyester sheets, and subsequent thermal treatment.

The contact electrodes can be incorporated into the resistive layer or conductive layer or fixed on this layer. The material of the layer or other known conductive contact glue can be used as the adhesive.

The insulating layers can consist of known insulating materials, for instance of polyester, and used in the form of sheets.

The length by which the contact electrodes protrude over at least one side of any given layer (resistive layer or conductive layer) can for instance be 5 mm. The gap between subdivisions coated with resistive mass or electroconductive material can for instance be 10 mm. When the heating element is cut apart in the middle of this gap, i.e., 5 mm a way from the nearest subdivision, then two heating element units are generated each having several possibilities for making contact along the cut.

The length of the subdivisions can for instance be 200 mm. The subdivisions can also be subdivided within themselves. To this end narrow bands of for instance 3 mm which are free of resistive mass or electroconductive material are provided at certain intervals of for instance 10 mm across the length and/or width. These bands make it possible to weld the insulating layers together at these locations and thus to improve the stability of the entire heating element, i.e., in particular the bonding of the individual layers.

When cutting up the heating element one can at once perform a heat treatment of the cut which serves to heat-seal the contact electrodes into the insulating layers and thus keep the heating element according to the invention in a water-tight condition.

By suitable selection of the materials for the resistive layer and the conductive layers and in view of the small thicknesses of the individual layers that can be employed in the heating element according to the invention, it is possible to produce heating elements of any desired size. Because of the flexibility of the entire heating element, this can be fabricated as a continuous product. This continuous product can be wound up on reels and taken off as needed. Traditional laminating equipment converting the layers to a multilayer structure can be used to produce such a continuous material. For a continuous product, preferably an embodiment of the heating element according to the invention is selected which has resistive mass and conductive material only in subdivisions, and where several electrode pairs are provided within the resistive layer while one contact electrode each in the first and second conductive layer is associated with each electrode pair.

The gaps between the subdivisions or the distances between the contact electrode of the resistive layer and a contact electrode of the first or second conductive layer that in projection is laterally offset relative to the former define cutting lines along which the heating element according to the invention can be cut apart. It is thus possible to cut the heating element to the desired size at the place of installation, and make the contacts with the power supply. Because of the multitude of contact electrode pairs in the resistive layer, several possibilities for contact making are provided across the width of the heating element which can be selected depending on the position of the power supply and of the surface to be heated.

It is further within the scope of the invention to provide a heating element in which more than two conductive layers are envisaged.

The position of the contact electrodes and of the subdivisions or of the resistive and conductive layer is preferably marked on the top and bottom insulating layer so that the user can readily recognize possible contact points.

What is claimed is:

1. A flat electrical resistance heating element, comprising:

an electrically resistive layer;

a first electrically conductive layer;

a second electrically conductive layer; and electrically insulating layers arranged between each of the electrically resistive layer, the first electrically conductive layer and the second electrically conductive layer; wherein the first electrically conductive layer comprises a neutral electrical conductor and the second electrically conductive layer comprises a protective conductor.

2. The flat electrical resistance heating element according to claim 1, characterized in that the electrically resistive layer has one contact electrode, each in the border region on two sides, and the first and second electrically conductive layer have one contact electrode, each in the border region, the contact electrodes protrude in a longitudinal direction on at least one side beyond the corresponding layers, and one contact electrode of the electrically resistive layer in projection is superimposed with the contact electrode of the first electrically conductive layer while the contact electrode of the second electrically conductive layer is offset relative to the contact electrode of the electrically resistive layer or to the contact electrode of the first electrically conductive layer.

3. The flat electrical resistance heating element according to claim 1, characterized in that in a horizontal and/or vertical direction, the contact electrodes are arranged essentially parallel to each other.

4. The flat electrical resistance heating element according to claim 1, characterized in that on the sides of the second electrically conductive layer and of the electrically resistive layer that face away from the other layers, one more electrically insulating layer each is arranged.

5. The flat electrical resistance heating element according to claim 1, characterized in that the ends of the contact electrodes protruding beyond the electrically conductive layers or the electrically resistive layer each are covered by the electrically insulating layers enveloping these layers.

6. The flat electrical resistance heating element according to claim 1, characterized in that the electrically resistive layer, comprises carbon black or an electroconductive polymer as the electrically resistive mass.

7. The flat electrical resistance heating element according to claim 1, characterized in that the electrically resistive layer, the first and the second electrically conductive layer all consist of the same material.

8. The flat electrical resistance heating element according to claim 1, characterized in that at least one electrically insulating layer serves as a supporting layer for the corresponding adjoining electrically conductive layer(s).

9. The flat electrical resistance heating element according to claim 1, characterized in that the electrically resistive layer and in the first and second electrically conductive layer, openings in the plane are provided, these openings being superimposed in projection.

10. The flat electrical resistance heating element according to claim 1, characterized in that the electrically resistive layer and the two electrically conductive layers each have an electrically conductive material in subdivisions while electrically resistive layer has at least two contact electrodes and the two electrically conductive layers each have at least one contact electrode each associated with a contact electrode pair of the electrically resistive layer which extend in a longitudinal direction in the corresponding layer and protrude at least on one end beyond the subdivisions provided with electrically conductive material or with electrically resistive mass.

11. The flat electrical resistance heating element according to claim 10, characterized in that the contact electrodes extend over the entire length of the heating element.

12. The flat electrical resistance heating element according to claim 10, characterized in that the subdivisions provided with electrically resistive mass or electrically conductive material extend over the entire width of the heating element.

13. The flat electrical resistance heating element according to claim 10, characterized in that the band-shaped gaps situated between the subdivisions of the corresponding layers are free of electrically resistive mass and electrically conductive material.

14. The flat electrical resistance heating element according to claim 10, characterized in that the subdivisions of the individual layers in projection are superimposed.

15. The flat electrical resistance heating element according to one of the preceding claims, characterized in that the layer thickness of peripheral electrically insulating layers is 50–200 $\mu$m., and that of internal insulating layers is 10–100 $\mu$m.

16. The flat electrical resistance heating element according to claim 1, characterized in that the layer thickness of the electrically conductive layers is 10–3000 $\mu$m, the layer thickness of the first electrically conductive layer preferably being 10–50 $\mu$m and that of the second electrically conductive layer preferably being 50–100 $\mu$m.

* * * * *